US011446736B2

(12) United States Patent
Jarbelius

(10) Patent No.: US 11,446,736 B2
(45) Date of Patent: Sep. 20, 2022

(54) METHOD OF MAKING A PATTERNED COMPOSITE METAL PLATE

(71) Applicant: DAMASTEEL AB, Soderfors (SE)

(72) Inventor: Per Jarbelius, Gavle (SE)

(73) Assignee: Damasteel AB, Söderfors (SE)

( * ) Notice: Subject to any disclaimer, the term of this patent is extended or adjusted under 35 U.S.C. 154(b) by 411 days.

(21) Appl. No.: 16/344,651

(22) PCT Filed: Oct. 9, 2017

(86) PCT No.: PCT/SE2017/050980
§ 371 (c)(1),
(2) Date: Apr. 24, 2019

(87) PCT Pub. No.: WO2018/080374
PCT Pub. Date: May 3, 2018

(65) Prior Publication Data

US 2020/0061713 A1 Feb. 27, 2020

(30) Foreign Application Priority Data

Oct. 27, 2016 (SE) ..... 1651408-5

(51) Int. Cl.
*B22F 5/00* (2006.01)
*B21C 37/02* (2006.01)
(Continued)

(52) U.S. Cl.
CPC ..... *B22F 5/006* (2013.01); *B21C 37/02* (2013.01); *B22F 3/15* (2013.01); *B22F 7/02* (2013.01);
(Continued)

(58) Field of Classification Search
CPC .... B22F 5/006; B22F 7/02; B22F 3/15; B22F 2003/247; B22F 2301/35; B22F 2998/10;
(Continued)

(56) References Cited

U.S. PATENT DOCUMENTS 3,171,195 A 3/1965 Darling
4,399,611 A 8/1983 Maringer
(Continued)

FOREIGN PATENT DOCUMENTS

CN 1140426 A 1/1997
CN 101905326 A 12/2010
(Continued)

OTHER PUBLICATIONS

Norimitsu "Long samurai sword, or katana", Jameel Centre, Ashmolean, downloaded from jameelcentre.ashmolean.org on May 2, 2021 (two pages), 2013, no month. (Year: 2013).*
(Continued)

*Primary Examiner* — Rebecca Janssen
(74) *Attorney, Agent, or Firm* — Karceski IP Law, PLLC

(57) ABSTRACT

A method of producing a patterned composite metal plate includes a) providing at least two different metal and/or metal alloy powders, b) filling a container, b1) with the powders in different individual layers, or b2) making a three dimensional non-solid body of one of the powders, inserting said body in the container and filling the cavities in and around the said body completely with the other powder, c) sealing and evacuating the container, d) subjecting the container to hot isostatic pressing, e) optionally subjecting the consolidated body to hot deformation to form an intermediate body having a thickness of 50 to 200 mm, f) hot rolling the intermediate body in two perpendicular directions in order to form a plate, and optionally one or more of g) cold rolling the hot rolled plate to form a cold rolled plate h) slitting the plate and i) etching the plate.

13 Claims, 1 Drawing Sheet

(51) Int. Cl.

| | |
|---|---|
| ***B22F 3/15*** | (2006.01) |
| ***B22F 7/02*** | (2006.01) |
| ***B22F 3/24*** | (2006.01) |
| ***B44C 3/00*** | (2006.01) |

(52) U.S. Cl.
CPC ..... *B44C 3/005* (2013.01); *B22F 2003/247* (2013.01); *B22F 2301/35* (2013.01)

(58) Field of Classification Search
CPC ..... B22F 7/06; B22F 2007/042; B22F 2003/185; B21C 37/02; B44C 3/005; B44C 3/02; Y02P 10/25; B21J 1/00; B32B 15/18
See application file for complete search history.

(56) References Cited

U.S. PATENT DOCUMENTS

| | | | | |
|---|---|---|---|---|
| 5,185,044 | A | 2/1993 | Verhoeven et al. | |
| 5,815,790 | A * | 9/1998 | Billgren ..... | B22F 3/1216 419/5 |
| 2003/0119599 | A1 | 6/2003 | Byrne et al. | |
| 2003/0162050 | A1* | 8/2003 | Ferry, III ..... | B23P 15/00 428/635 |
| 2010/0227193 | A1 | 9/2010 | Midgett | |
| 2012/0107561 | A1 | 5/2012 | Hirama et al. | |
| 2013/0058824 | A1 | 3/2013 | Hirama et al. | |

FOREIGN PATENT DOCUMENTS

| | | | |
|---|---|---|---|
| CN | 102933337 | A | 2/2013 |
| CN | 103691952 | A | 4/2014 |
| CN | 105217605 | A | 1/2016 |
| CN | 105992661 | A | 10/2016 |
| DE | 102009010149 | A1 | 9/2010 |
| GB | 2055901 | A | 3/1981 |
| JP | H05171225 | A | 7/1993 |
| JP | H0610011 | A | 1/1994 |
| JP | H06192704 | A | 7/1994 |
| JP | H101703 | A | 1/1998 |
| JP | 2006102762 | A | 4/2006 |
| JP | 2012192163 | A | 10/2012 |
| RU | 2288101 | C1 | 11/2006 |
| RU | 2008110571 | A | 9/2009 |
| RU | 2561407 | C1 | 8/2015 |
| WO | 9519861 | | 7/1995 |
| WO | 2005110660 | A1 | 11/2005 |
| WO | 2010118820 | A1 | 10/2010 |
| WO | 2015076771 | A2 | 5/2015 |
| WO | 2015150479 | A1 | 10/2015 |

OTHER PUBLICATIONS

Chinese Office Action dated Jan. 14, 2021, for Chinese Patent Application No. 201780067454.2.
European Office Action dated Dec. 23, 2020, for European Patent Application No. 17864918.2.
International Search Report and Written Opinion dated Nov. 16, 2017 for International Patent Application No. PCT/SE2017/050980.
European Search Report dated Jan. 21, 2020 for European Patent Application No. 17864918.2.
European Office Action dated May 14, 2020, for European Patent Application No. 17864918.2.
European Office Action dated Sep. 7, 2020, for European Patent Application No. 17864918.2.
Japanese Office Action dated Mar. 2, 2021, for Japanese Patent Application No. 2019-522729.
Russian Office Action dated Jun. 5, 2020, for Russian Patent Application No. 2019112785/05(024758).
Russian Search Report dated Jun. 5, 2020, for Russian Patent Application No. 2019112785/05(024758).

* cited by examiner

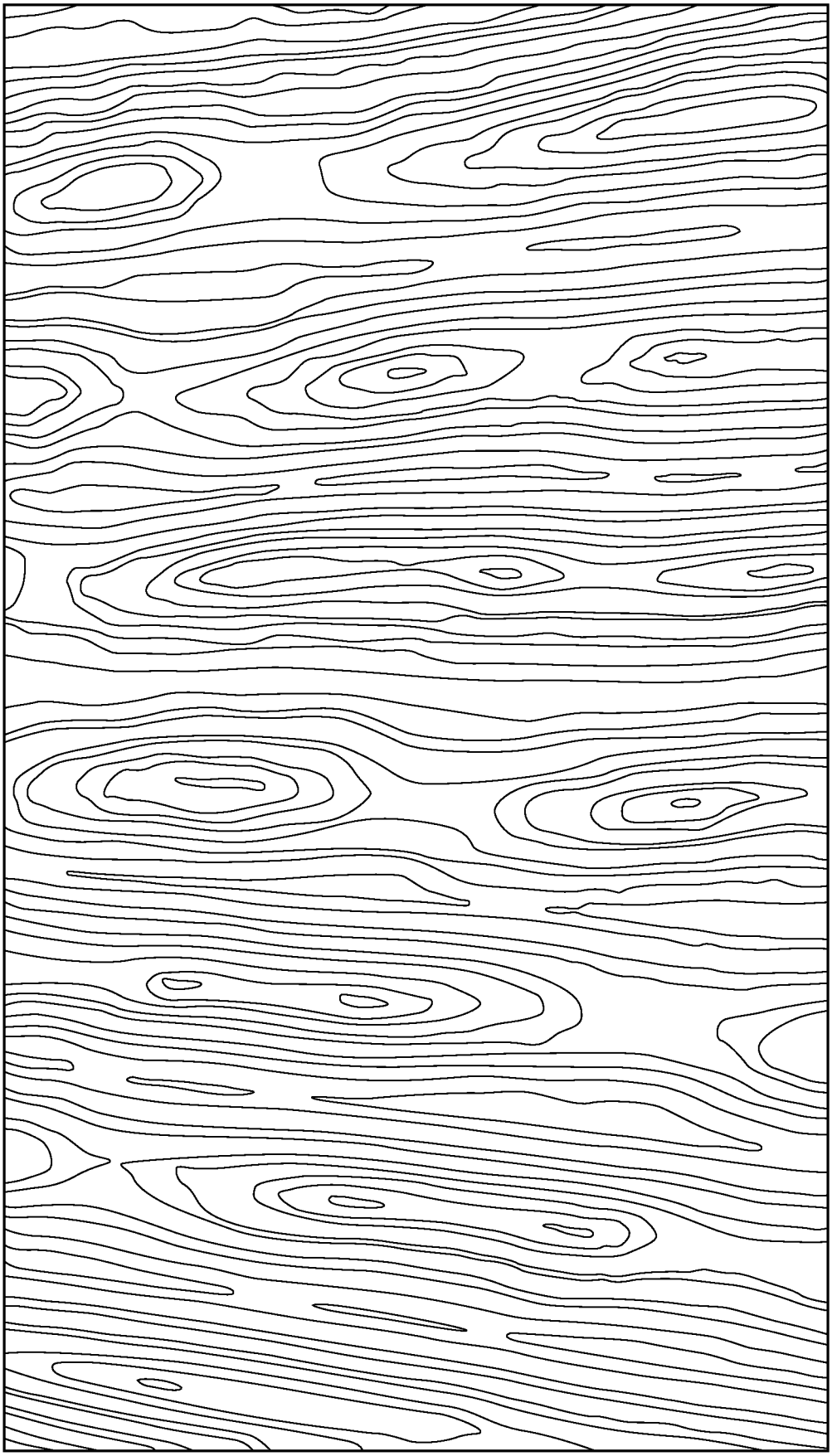

METHOD OF MAKING A PATTERNED COMPOSITE METAL PLATE

CROSS-REFERENCE TO RELATED APPLICATION(S)

This is a National Stage Entry into the United States Patent and Trademark Office from International PCT Patent Application No. PCT/SE2017/050980, having an international filing date of Oct. 9, 2017, which claims priority to Swedish Patent Application No. SE 1651408-5, filed on Oct. 27, 2016, the entire contents of both of which are incorporated herein by reference.

TECHNICAL FIELD

The invention relates to a method of making a patterned composite metal plate. In particular the invention relates to a method of producing a composite plate, which can be used for the manufacture of decorative metal objects.

BACKGROUND OF THE INVENTION

Decorative metal manufacturing techniques have been known for hundreds of years for making mixed metal laminates having distinct layered patterns. Forge welding was used in Syria to produce hard and flexible Damascus steel for the blades of swords and knives. In Japan a similar technique called Mokume Gane was used for the same purpose. The objects obtained in this way are referred to have a damascened pattern.

Nowadays, damascene patterned metal objects are produced in many different ways for a large number of material combinations. WO2015076771, WO2010118820 and U.S. Pat. No. 4,399,611 disclose different lamination techniques for obtaining the desired decorative pattern.

US20100227193 and U.S. Pat. No. 3,171,195 disclose extrusion methods, wherein one metal may be provided in the form of a powder.

WO9519861 discloses the making of stainless composite metal products having a damascene pattern, including the step of 1) providing a capsule comprising at least two stainless steel powders arranged in parallel elongated layers, 2) hot isostatic pressing the capsule for forming a blank, 3) forging and hot rolling the blank to an intermediate dimension, 4) distorting the elongated structure by mechanical working and thereafter 5) hot working the blank to the final dimension. To be specific, WO9519861 discloses in Example 3 hot rolling to a bar diameter of 18 mm and thereafter twisting the bar 40 turns/in around its own axis and flat rolling for obtaining the damascene pattern in the final product.

All the above techniques result in damascene patterned objects having a relatively small size. The use has therefore been restricted to small sized objects such as knives, weapons, golf club heads, rings and other jewelry.

SUMMARY OF THE INVENTION

The general object of the present invention is to provide an improved method for making patterned composite metal plate from powders.

Another object is to provide a method for making large size plates, which can be used to produce large size objects having a decorative pattern, in particular of the damascene type.

These objects are achieved by the means of the invention as defined in the independent claims.

Further advantageous embodiment of the invention have been specified in the dependent claims.

The present invention overcomes the drawbacks of the limited size of the composite material obtainable with the method known from WO9519861, by filling the powder container such that the step of distorting the elongated structure by mechanical working such as twisting needs not be performed, because the container is filled in a way such that the pattern will form during the normal hot deformation.

BRIEF DESCRIPTION OF THE FIGURES

In the following, the invention will be described in more detail with reference to the preferred embodiments and the appended drawing.

The sole FIGURE discloses the pattern of a plate produced by the present method.

DETAILED DESCRIPTION OF THE INVENTION

The claimed method of producing a patterned composite metal plate comprising the steps of:

a) providing at least two different metal and/or metal alloy powders,
b) filling a container,
  b1) with the powders in different individual layers, wherein the individual power layers include at least two non parallel layers and/or non straight layers, or
  b2) making a three dimensional non-solid body of one of the powders, which comprises least two non parallel parts of layers and/or non straight parts or layers, inserting said body in the container and filling cavities in and around the said body with the other powder,
c) sealing and evacuating the container,
d) subjecting the container to hot isostatic pressing in order to form a consolidated body comprising non parallel and/or non straight metal and/or metal alloy layers,
e) optionally subjecting the consolidated body to hot deformation in order to form an intermediate body having a thickness of 50 to 200 mm,
f) hot rolling the consolidated or the intermediate body in two perpendicular directions in order to form a plate, optionally
g) cold rolling the hot rolled plate in order to form a cold rolled plate
h) slitting the plate in two or more parts and
i) etching the plate in order to reveal or enhance the pattern.

The method involves the use of at least two different metal and/or metal alloy powders. Accordingly, if the powders are carefully produced it is possible to manufacture a plate having a high cleanliness and a small size of any hard phases present. The Equivalent Circle Diameter (ECD) of at least 95 vol. % of any oxide particles may be ≤10 μm and the ECD of at least 95 vol. % of any carbide and/or carbonitride particles may be ≤5 μm, wherein the $ECD=2\sqrt{A/\pi}$, where A is the surface of the particles in the studied section.

The claimed method can be applied to any metal or metal alloys that can be consolidated by Hot Isostatic Pressing (HIP). In particular the metal and/or metal alloy powders may comprise one or more of the following metals: Ag, Al, Au, Be, Bi, Cu, Ce, Cr, Fe, Mo, Nb, Ni, Pb, Pd, Pt, Sn, Ta, Ti, V, W and Zn. For many applications stainless steel powders are the best choice. The stainless steel powders comprise at least 11% Cr, preferably at least 13% Cr.

The method of filling the container is a key feature or the present invention, because the container is filled in a way such that the pattern will form during the normal hot deformation. Accordingly, the conventional step of size reduction and distortion of the elongated structure need not be performed.

One way of filling the container is to use two different metal and/or metal alloy powders and filling the container with the powders in separate individual layers, wherein the individual power layers include at least two non parallel layers and/or non straight layers. This can be done by placing a vertically movable powder-filling tool inside the stationary container, moving different individual filling sections of the powder-filling tool, which are connected to the respective powder source, independently of each other. Alternately, the feed of powder to one or more of the individual filling sections may be stopped for a certain time. These measures allow the individual power layers from the neighbouring section to flow also in the horizontal direction and form non parallel layers and/or non straight layers. In this way the ground for the desired pattern is formed already in the container.

Another way of forming the ground for the desired pattern is to make a three dimensional non-solid body of one of the powders, thereby inserting the body in the container and filling the container completely with the other powder. The body can be manufactured by a technique known as 3D-printing or Additive Manufacturing Again the body must comprise at least two non parallel parts or layers and/or non straight parts or layers. The only restriction to the geometry of the body is that it must allow the complete filling of the container with the other powder.

The hot rolling in two perpendicular directions results in a product, that can have a substantial width. The width can be influenced by the size of the HIPed container and the rolling parameters. However, for practical reasons the size of the hot rolled plate may be in the range of 0.6 m×1.5 m to 1.0 m×3 m. The thickness (t) of the hot rolled plate may be 1-15 mm. The upper limit may be 12, 10, 8 or 6 mm and the lower limit may be 2, 3 or 4 mm. The width (w) of the plate is at least 50 mm, the smallest width may be set to 100 mm, 150 mm, 170 mm, 190 mm, 210 mm, 250 mm, 300 mm, 400 mm, 500 mm 600 mm or 700 mm. The length (l) of the plate is larger the width (w) of the plate. The length depends on the size of the container used for HIPing and can e.g. be adjusted to 1 m, 1.5 m, 2 m, 2.5 m, 3 m, 3.5 m or even more.

The hot rolled plate may be subjected to cold rolling in order to produce a cold rolled plate, which may have a thickness in the range of 0.1-3 mm, preferably 0.2-2 mm, more preferably 0.5-1.5 mm. The width of the cold rolled plate may be adjusted by slitting the plate. The hot rolled plate may also be subjected to slitting and/or cutting in order to obtain the desired width and length.

The invention is defined in the claims.

EXAMPLE

A patterned composite metal plate was produced from the two austenitic stainless steel powders 316L and 304L. The powders were filled in two supply units, wherein each unit was connected to different individual parts of a vertically movable powder-filling tool: The filling tool was placed inside a container having a diameter of 250 mm, which remained stationary during the powder filling.

During the powder filling, different individual filling sections of the powder-filling tool were moved upwards independent of each other in a way such that ground for the desired pattern was formed inside the container, because the individual power layers could flow also in the horizontal direction during the filling and thereby form non parallel and non straight layers of the powders supplied. Thereafter the container was sealed and evacuated and processed according to standard HIP practice 1150° C., 1000 bar, 1 h.

The consolidated body was forged to a block having a thickness of 100 mm, a width of 300 mm and a length of 1 m and then it was subjected to conventional hot rolling including a step of producing a slab having a thickness of 41 mm, a length of 960 mm and a width of 260 mm. Subjecting said slab to conventional hot rolling in two perpendicular directions in order to produce a plate having a thickness of about 2.74 mm, a length of 3 m and a width of 900 mm.

A sample was cut out of the plate and was subjected to polishing and etching in order to further enhance the pattern. The result is disclosed in FIG. 1.

The invention claimed is:

1. A method of producing a patterned composite metal plate, comprising:

a) providing at least two different metal and/or metal alloy powders, wherein at least one of the metal and/or metal alloy powders comprises Fe, b) filling a container, b1) with the powders in different individual layers, wherein the individual power layers include at least two non parallel layers and/or non straight layers, or b2) making a three dimensional non-solid body of one of the powders, which comprises least two non parallel parts or layers and/or non straight parts or layers, inserting said body in the container and filling the cavities in and around the said body completely with the other powder, c) evacuating the container to remove gases therefrom and sealing the evacuated container, d) subjecting the container to hot isostatic pressing to form a consolidated body comprising non parallel and/or non straight metal and/or metal alloy layers, e) optionally subjecting the consolidated body to hot deformation to form an intermediate body having a thickness of 50 to 200 mm, f) hot rolling the consolidated or the intermediate body in two perpendicular directions to form a plate, and optionally one or more of g) cold rolling the hot rolled plate to form a cold rolled plate, h) slitting the plate in two or more parts, and i) etching the plate to reveal or enhance the pattern.

2. The method according to claim 1, wherein the pattern is a damascene pattern.

3. The method according to claim 1, wherein thickness (t), width (w) and length (l) of the plate fulfil at least one of the requirements t=1-15 mm, w≥50 mm and l≥w.

4. The method according to claim 1, wherein the metal and/or metal alloy powders comprise one or more of the following metals:

Ag, Al, Au, Be, Bi, Cu, Ce, Cr, Mo, Nb, Ni, Pb, Pd, Pt, Sn, Ta, Ti, V, W and Zn.

5. The method according to claim 1, wherein the metal and/or metal alloy powders are stainless steel powders, each comprising at least 11% Cr.

6. A patterned composite metal plate obtained by the method according to claim 1, wherein the plate comprises at least two different metals and/or metal alloys, and wherein thickness (t), width (w) and length (l) of the plate fulfil the requirements t=0.1-15 mm, w≥50 mm and l≥w.

7. The patterned composite metal plate according to claim 6, fulfilling at least one of the following requirements:

t: 0.2-6 mm, w: 30-100 cm, and l: 50-300 cm.

8. The patterned composite metal plate according to claim 6, wherein the pattern is a damascene pattern.

9. The patterned composite metal according to claim 6, wherein the at least two different metals and/or metal alloys comprise one or more of the following metals: Ag, Al, Au, Cu, Cr, Mo, Nb, Ni, Pb, Pd, Pt, Sn, Ta, Ti, V, W and Zn.

10. The patterned composite metal plate according to claim 6, wherein the at least two different metals and/or metal alloys are stainless steels, each comprising at least 11% Cr, and optionally, wherein the Equivalent Circle Diameter (ECD) of at least 95 vol. % of any oxide particles is ≤10 μm and that the ECD of at least 95 vol. % of any carbide and/or carbonitride particles is ≤5 μm, wherein the $ECD=2\sqrt{A\pi}$, where A is the surface of the particles in the studied section.

11. The method according to claim 5, wherein the powders are stainless powders, each comprising at least 13% Cr.

12. The patterned composite metal plate according to claim 10, wherein the at least two different metals and/or metal alloys are stainless steel, each comprising at least 13% Cr.

13. A method of producing at least one patterned knife, comprising:

a) providing at least two different metal and/or metal alloy powders, wherein at least one of the metal and/or metal alloy powders comprises Fe, b) filling a container, b1) with the powders in different individual layers, wherein the individual power layers include at least two non parallel layers and/or non straight layers, or b2) making a three dimensional non-solid body of one of the powders, which comprises least two non parallel parts or layers and/or non straight parts or layers, inserting said body in the container and filling the cavities in and around the said body completely with the other powder, c) evacuating the container to remove gases therefrom and sealing the evacuated container, d) subjecting the container to hot isostatic pressing to form a consolidated body comprising non parallel and/or non straight metal and/or metal alloy layers, e) optionally subjecting the consolidated body to hot deformation to form an intermediate body having a thickness of 50 to 200 mm, f) hot rolling the consolidated or the intermediate body in two perpendicular directions to form a plate, g) cold rolling the hot rolled plate to form a cold rolled plate, h) slitting the plate in two or more parts to form strips, i) cutting the strips to form blanks, j) using the blanks to form at least one knife, and k) etching the at least one knife to reveal or enhance the pattern.

* * * * *